US009161125B2

(12) United States Patent
Nystrom

(10) Patent No.: US 9,161,125 B2
(45) Date of Patent: Oct. 13, 2015

(54) HIGH DYNAMIC MICROPHONE SYSTEM

(75) Inventor: Martin Nystrom, Horja (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 0 days.

(21) Appl. No.: 13/812,219

(22) PCT Filed: Jan. 17, 2012

(86) PCT No.: PCT/IB2012/050227
§ 371 (c)(1),
(2), (4) Date: Jan. 25, 2013

(87) PCT Pub. No.: WO2013/108077
PCT Pub. Date: Jul. 25, 2013

(65) Prior Publication Data

US 2014/0328501 A1 Nov. 6, 2014

(51) Int. Cl.

| | |
|---|---|
| ***H04R 3/00*** | (2006.01) |
| ***H04R 3/02*** | (2006.01) |
| ***H04R 19/00*** | (2006.01) |
| ***H04R 19/04*** | (2006.01) |

(52) U.S. Cl.
CPC ..... *H04R 3/005* (2013.01); *H04R 3/02* (2013.01); *H04R 19/005* (2013.01); *H04R 19/04* (2013.01); *H04R 2410/05* (2013.01)

(58) Field of Classification Search
None
See application file for complete search history.

(56) References Cited

U.S. PATENT DOCUMENTS

2008/0205668 A1* 8/2008 Torii et al. ..... 381/113
2009/0323973 A1* 12/2009 Dyba ..... 381/58

FOREIGN PATENT DOCUMENTS

| | | | |
|---|---|---|---|
| EP | 1962546 | A2 | 8/2008 |
| WO | 2008014324 | A2 | 1/2008 |
| WO | 2009143434 | A2 | 11/2009 |

OTHER PUBLICATIONS

International Search Report and Written Opinion; Oct. 29, 2012; issued in International Patent Application No. PCT/IB2012/050227.
International Preliminary Report on Patentability; Jul. 31, 2014; issued in International Patent Application No. PCT/IB2012/050227.

* cited by examiner

*Primary Examiner* — Andrew L Sniezek
(74) *Attorney, Agent, or Firm* — Patrick B. Home; Moore & Van Allen PLLC

(57) ABSTRACT

The invention is directed to systems, methods and computer program products associated with a microphone system for receiving a sound and producing an output signal representing the sound. The microphone system has a first microphone having a first dynamic range, the first microphone to receive the sound and produce a first sound signal based on the received sound. It also has a second microphone having a second dynamic range, the second microphone to receive the sound and produce a second sound signal based on the received sound, wherein the first dynamic range and the second dynamic range overlap thereby forming a transition dynamic range and processing logic operatively coupled to the first microphone and the second microphone. The processing logic is configured to receive the first sound signal from the first microphone, receive the second sound signal from the second microphone, and generate the output signal by combining the first sound signal and the second sound signal.

19 Claims, 8 Drawing Sheets

HIGH DYNAMIC MICROPHONE SYSTEM

BACKGROUND

Sound pressure, also known as acoustic pressure, is the local pressure deviation from the ambient atmospheric pressure caused by a sound wave. Sound pressure can be measured using a microphone in air, and the SI unit for sound pressure is the pascal (Pa). The sound pressure level is a logarithmic measure of the effective sound pressure of a sound related to a reference value. Sound pressure level is measured in decibels (dB), typically above a standard reference level in air of 20 μPa RMS, which is usually considered the threshold of human hearing. Thus, the units for sound pressure level, when measured over the standard reference level are "dB (SPL)".

Multiple microphones have been used in conjunction. For example, a combination of two microphone capsules by frequency division has been used. Such an implementation may be motivated to achieve a very wide frequency response by using, for example, a large membrane capsule for low frequency and a smaller membrane for high frequency. The combined result typically then achieves a smoother and wider response than either of the two microphone capsules individually may achieve. Another motivation to combine such microphone capsules by frequency division is that when directional microphone capsules are used, the polar pattern in first order microphones is, by nature, difficult to achieve for full audio bandwidth. By combining a microphone capsule with a good polar pattern in low frequency with another microphone capsule having a good polar pattern in high frequency, a wide bandwidth polar pattern may be achieved.

BRIEF SUMMARY

Embodiments of the invention are directed to systems, methods and computer program products associated with a microphone system for receiving a sound and producing an output signal representing the sound. The microphone system includes a first microphone having a first dynamic range, where the first microphone is to receive the sound and produce a first sound signal based on the received sound. A second microphone has a second dynamic range and is to receive the sound and produce a second sound signal based on the received sound, where the first dynamic range and the second dynamic range overlap thereby forming a transition dynamic range. The microphone system also has processing logic operatively coupled to the first microphone and the second microphone. The processing logic is configured to receive the first sound signal from the first microphone, receive the second sound signal from the second microphone, and generate the output signal by combining the first sound signal and the second sound signal.

In some embodiments, the first dynamic range has a first minimum sound pressure level and a first maximum sound pressure level and the second dynamic range has a second minimum sound pressure level and a second maximum sound pressure level. The first minimum sound pressure level is lower than the second minimum sound pressure level, and the first maximum sound pressure level is lower than the second maximum sound pressure level.

In some such embodiments, the processing logic is configured to generate the output signal by combining the first sound signal and the second sound signal at least in part by switching from the first sound signal to the second sound signal based at least in part on a sound pressure level of the first sound signal rising above the first maximum sound pressure level. In other such embodiments, the processing logic is configured to generate the output signal by combining the first sound signal and the second sound signal at least in part by switching from the first sound signal to the second sound signal based at least in part on a sound pressure level of the first sound signal rising above the second minimum sound pressure level. In yet other such embodiments, the processing logic is configured to generate the output signal by combining the first sound signal and the second sound signal at least in part by switching from the second sound signal to the first sound signal based at least in part on a sound pressure level of the second sound signal falling below the first maximum sound pressure level. In yet other such embodiments, the processing logic is configured to generate the output signal by combining the first sound signal and the second sound signal by switching from the second sound signal to the first sound signal based at least in part on a sound pressure level of the second sound falling below the second minimum sound pressure level.

In some embodiments, the microphone system also includes a first analog to digital converter configured to receive the first sound signal and convert the first sound signal from analog to digital prior to the processing logic receiving the first sound signal and a second analog to digital converter configured to receive the second sound signal and convert the second sound signal from analog to digital prior to the processing logic receiving the second sound signal. In some embodiments, the processing logic is configured to generate the output signal by combining the first sound signal and the second sound signal at least in part by switching from the first sound signal to the second sound signal based at least in part on the first microphone becoming saturated. In some embodiments, the processing logic is configured to generate the output signal by combining the first sound signal and the second sound signal at least in part by switching from the second sound signal to the first sound signal based at least in part on the second microphone reaching a noise level.

In some embodiments, the processing logic is configured to generate the output signal by combining the first sound signal and the second sound signal at least in part by switching between the first sound signal and the second sound signal substantially instantaneously in response to the first sound signal or the second sound signal passing through the transition dynamic range. In other embodiments, the processing logic is configured to generate the output signal by combining the first sound signal and the second sound signal at least in part by switching from the first sound signal to the second sound signal based at least in part on the first microphone being saturated for a predetermined period of time. In some embodiments, the processing logic is configured to generate the output signal by combining the first sound signal and the second sound signal at least in part by switching from the second sound signal to the first sound signal based at least in part on the second microphone reaching a noise level for a predetermined period of time.

In some embodiments, the first microphone and the second microphone are microelectromechanical system (MEMS) microphones. In some such embodiments, the first microphone and the second microphone share a single input hole in a housing of a mobile device. In some such embodiments, the first microphone and the second microphone are disposed on a single chip.

In some embodiments, where the first dynamic range has a first minimum sound pressure level and a first maximum sound pressure level and the second dynamic range has a second minimum sound pressure level and a second maximum sound pressure level, and where the first minimum sound pressure level is lower than the second minimum sound pressure level, and the first maximum sound pressure level is lower than the second maximum sound pressure level, the microphone system also includes a third microphone. The third microphone has a third dynamic range and is to receive the sound and produce a third sound signal based on the received sound. The third dynamic range has a minimum sound pressure level higher than the second minimum sound pressure level and a maximum sound pressure level higher than the second maximum sound pressure level, the processing logic is operatively coupled to the third microphone. The processing logic is further configured to receive the third sound signal from the third microphone and generate the output signal by combining the first sound signal, the second sound signal and the third sound signal at least in part by switching from the second sound signal to the third sound signal based at least in part on the sound pressure level of the second signal rising above the second maximum sound pressure level or based at least in part on the sound pressure level of the second signal rising above the third minimum sound pressure level.

According to embodiments of the invention, a method for receiving a sound and producing an output signal representing the sound includes providing a microphone system comprising a first microphone having a first dynamic range. The first microphone is to receive the sound and produce a first sound signal based on the received sound. The microphone system also has a second microphone having a second dynamic range, where the second microphone is to receive the sound and produce a second sound signal based on the received sound. The first dynamic range and the second dynamic range overlap thereby forming a transition dynamic range. The first dynamic range has a minimum sound pressure level and a maximum sound pressure level, and the second dynamic range has a minimum sound pressure level and a maximum sound pressure level. The first minimum sound pressure level is lower than the second minimum sound pressure level, and the first maximum sound pressure level is lower than the second maximum sound pressure level. The method also includes receiving the first sound signal from the first microphone, receiving the second sound signal from the second microphone, and generating the output signal by combining the first sound signal and the second sound signal at least in part by switching from the first sound signal to the second sound signal based at least in part on the first microphone becoming saturated and switching from the second sound signal to the first sound signal based at least in part on the second microphone reaching a noise level.

In some embodiments, generating the output signal comprises switching from the first sound signal to the second sound signal based at least in part on the first microphone being saturated for a predetermined period of time and switching from the second sound signal to the first sound signal based at least in part on the second microphone reaching a noise level for a predetermined period of time.

According to embodiments of the invention, a computer program product for receiving a sound and producing an output signal representing the sound has a non-transitory computer-readable medium including computer-executable instructions for receiving a first sound signal from a first microphone, receiving a second sound signal from a second microphone, and generating the output signal by combining the first sound signal and the second sound signal at least in part by switching from the first sound signal to the second sound signal based at least in part on the first microphone becoming saturated and switching from the second sound signal to the first sound signal based at least in part on the second microphone reaching a noise level.

In some embodiments, the instructions for generating the output signal include instructions for switching from the first sound signal to the second sound signal based at least in part on the first microphone being saturated for a predetermined period of time and switching from the second sound signal to the first sound signal based at least in part on the second microphone reaching a noise level for a predetermined period of time.

BRIEF DESCRIPTION OF THE DRAWINGS

Figure 1A:
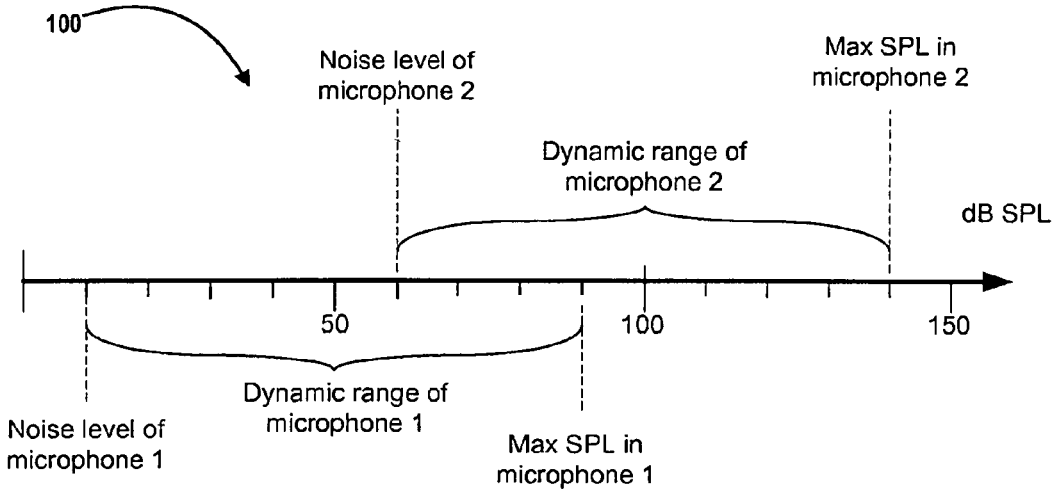
Figure 1B:
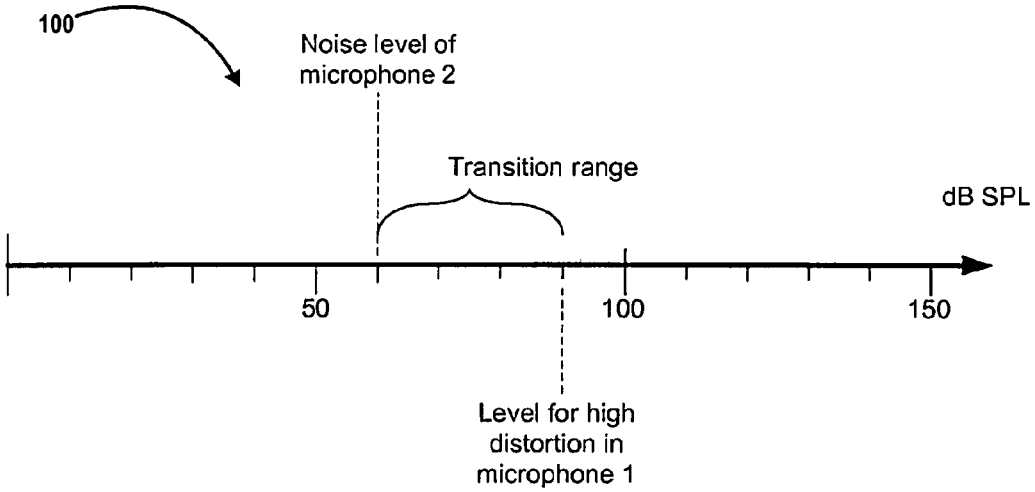
Figure 1C:
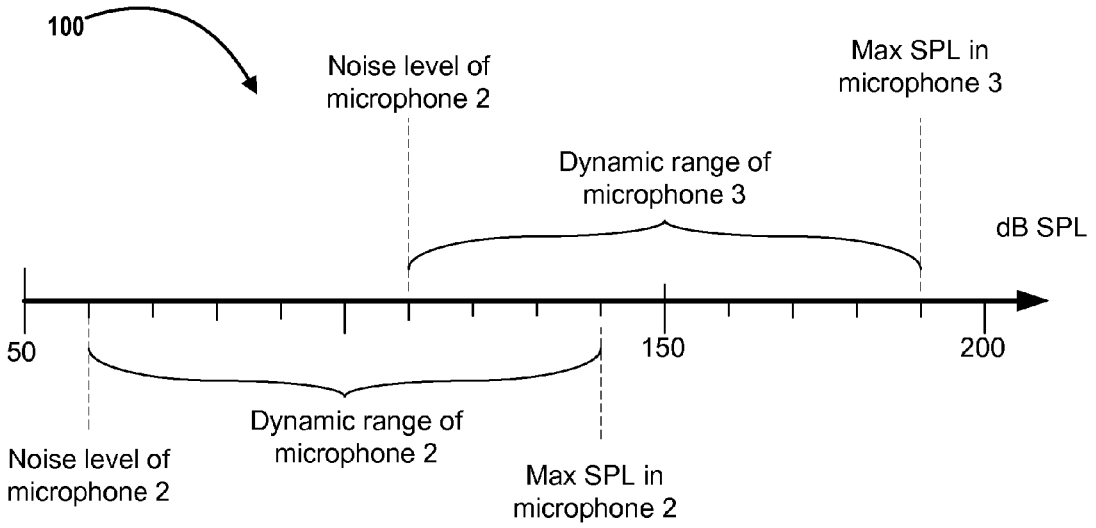
Figure 1D:
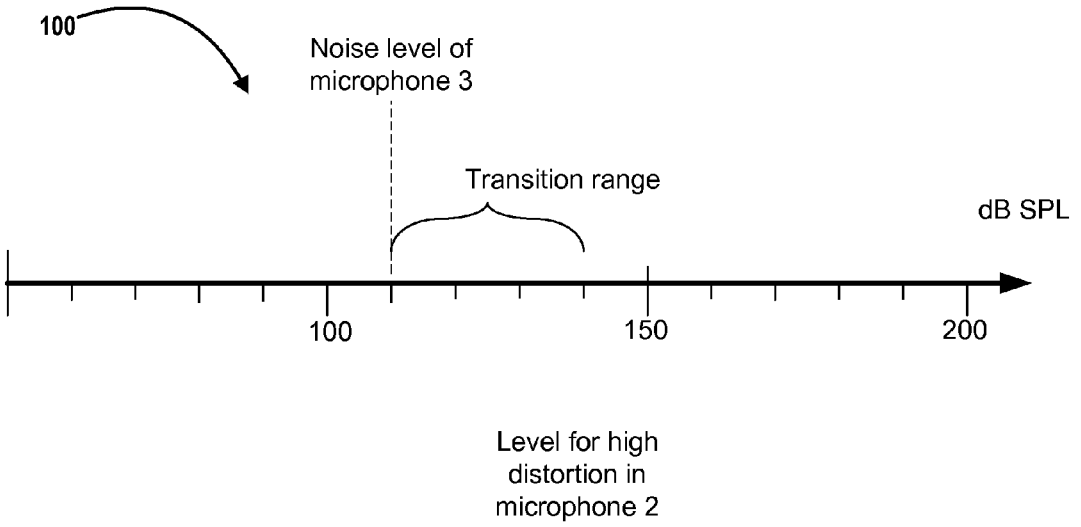
Figure 2:
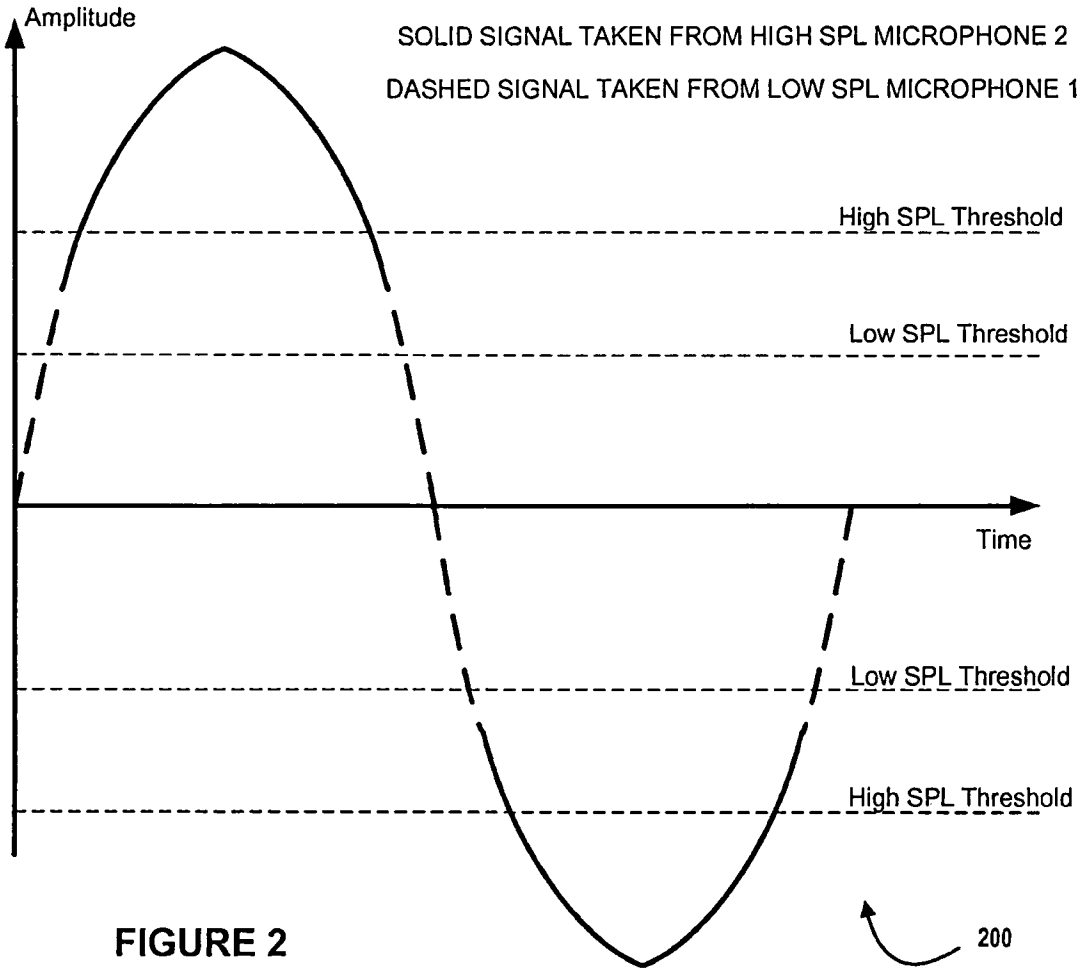
Figure 3:
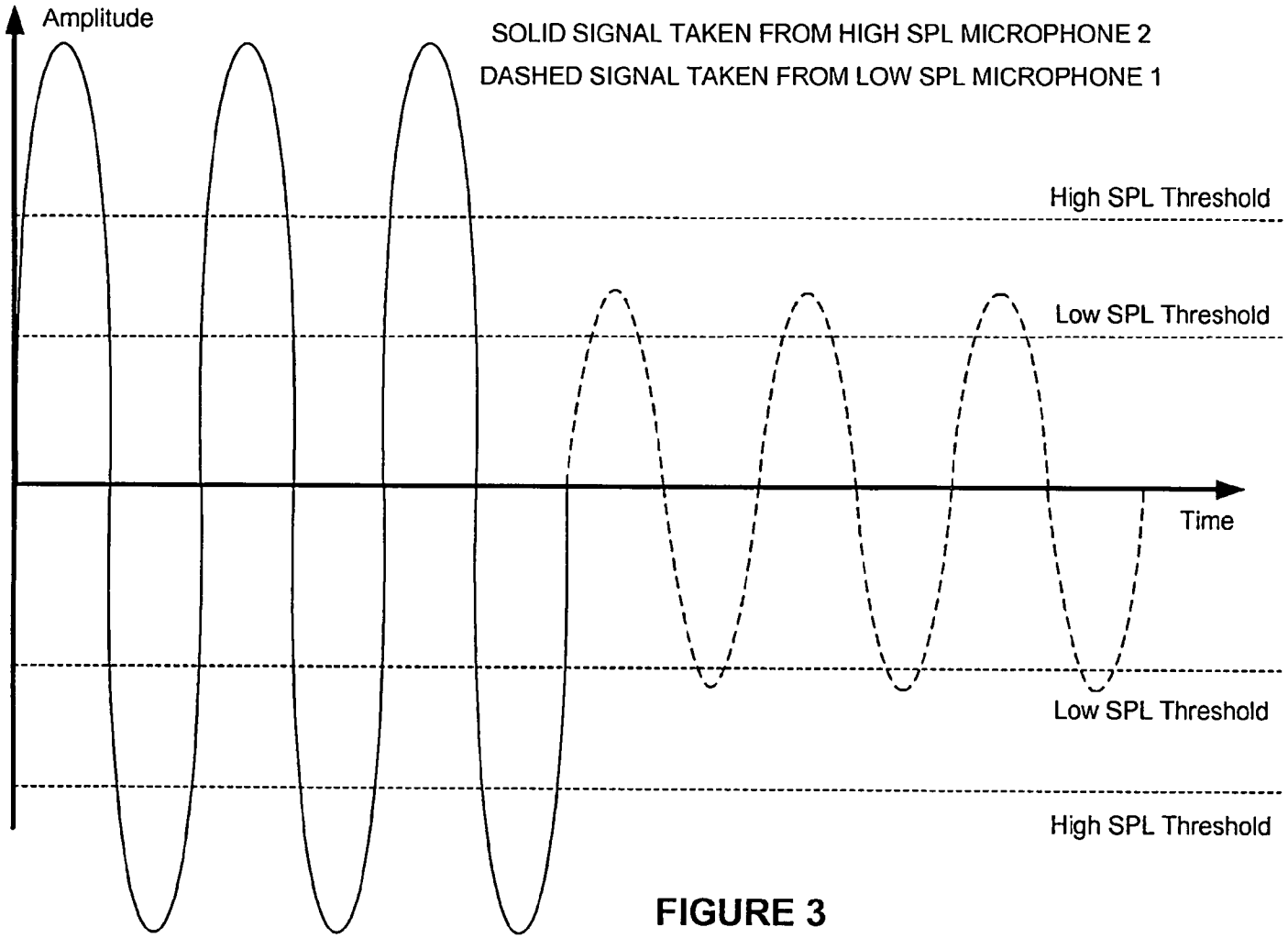
Figure 4:
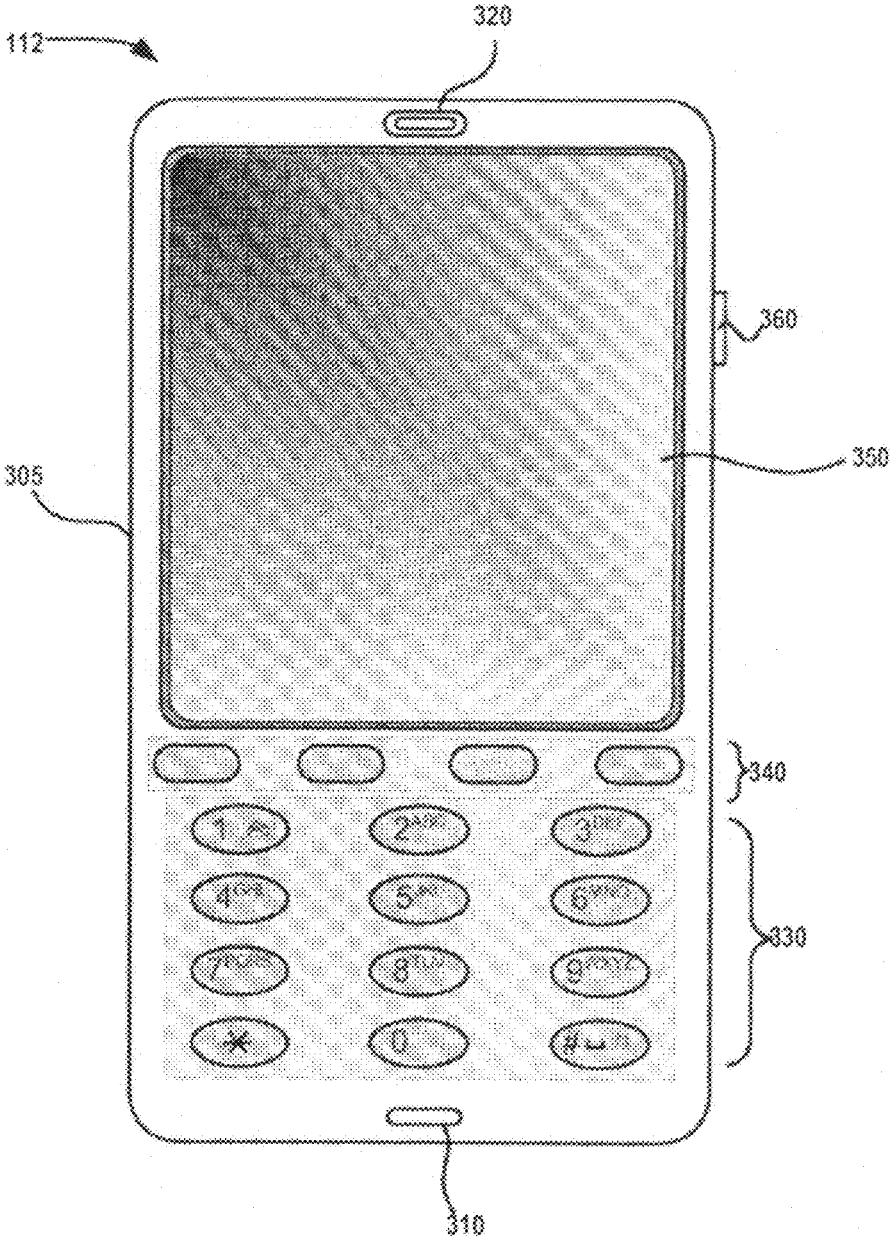
Figure 5:
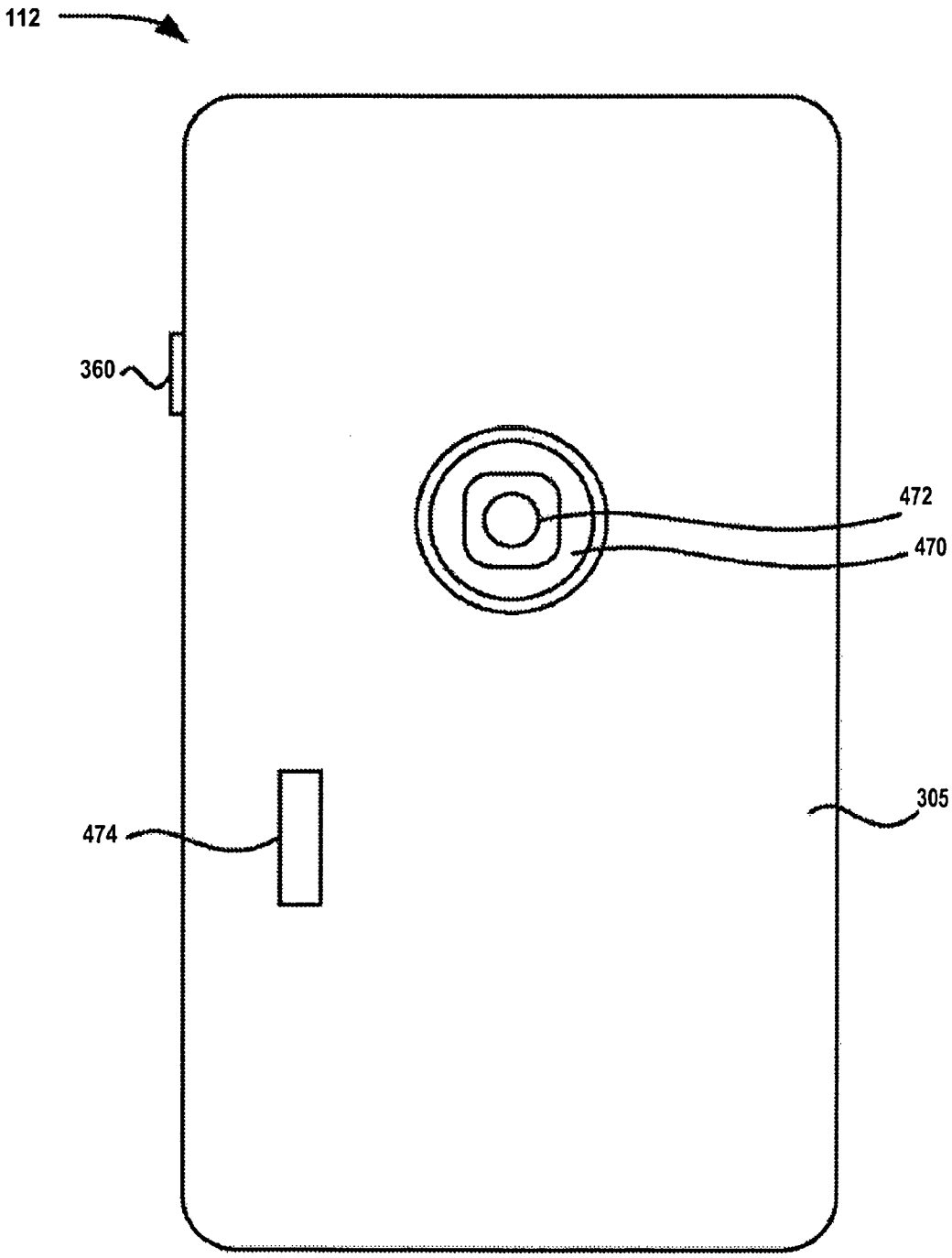
Figure 6:
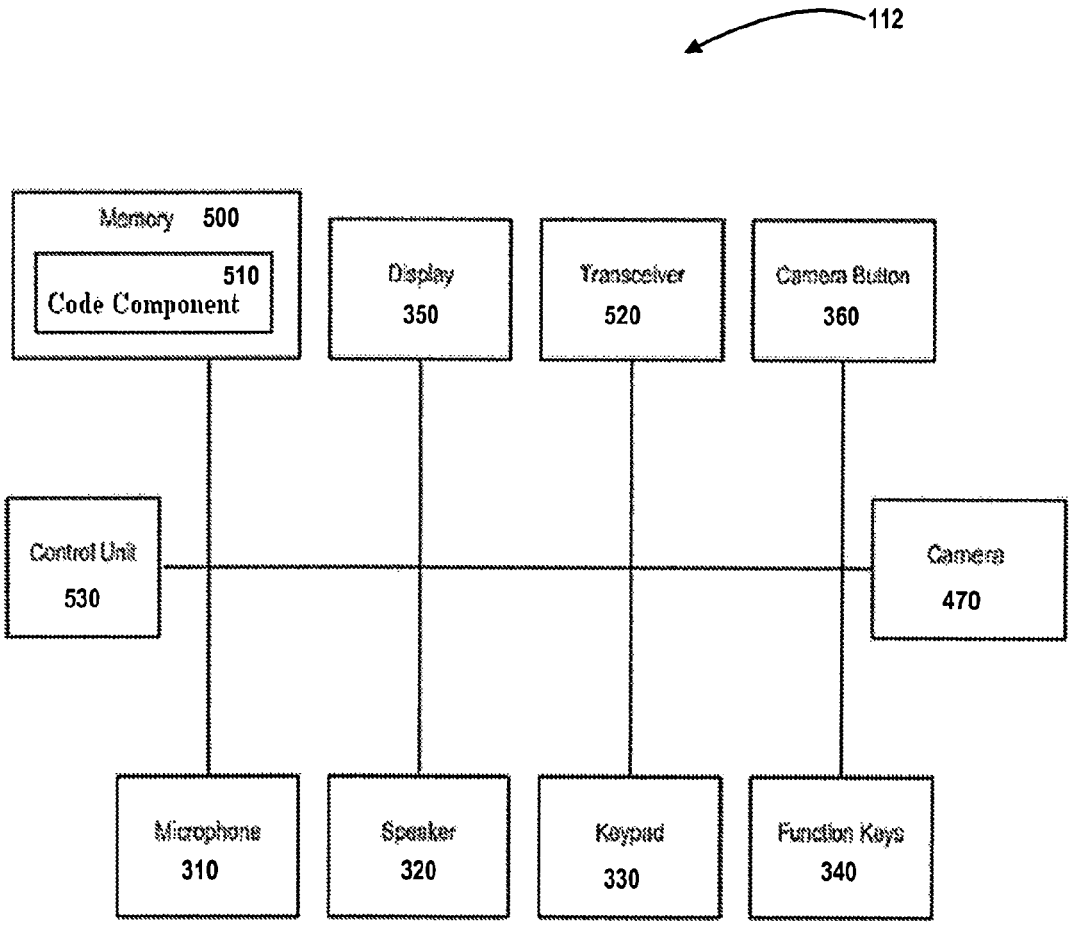
Figure 7:
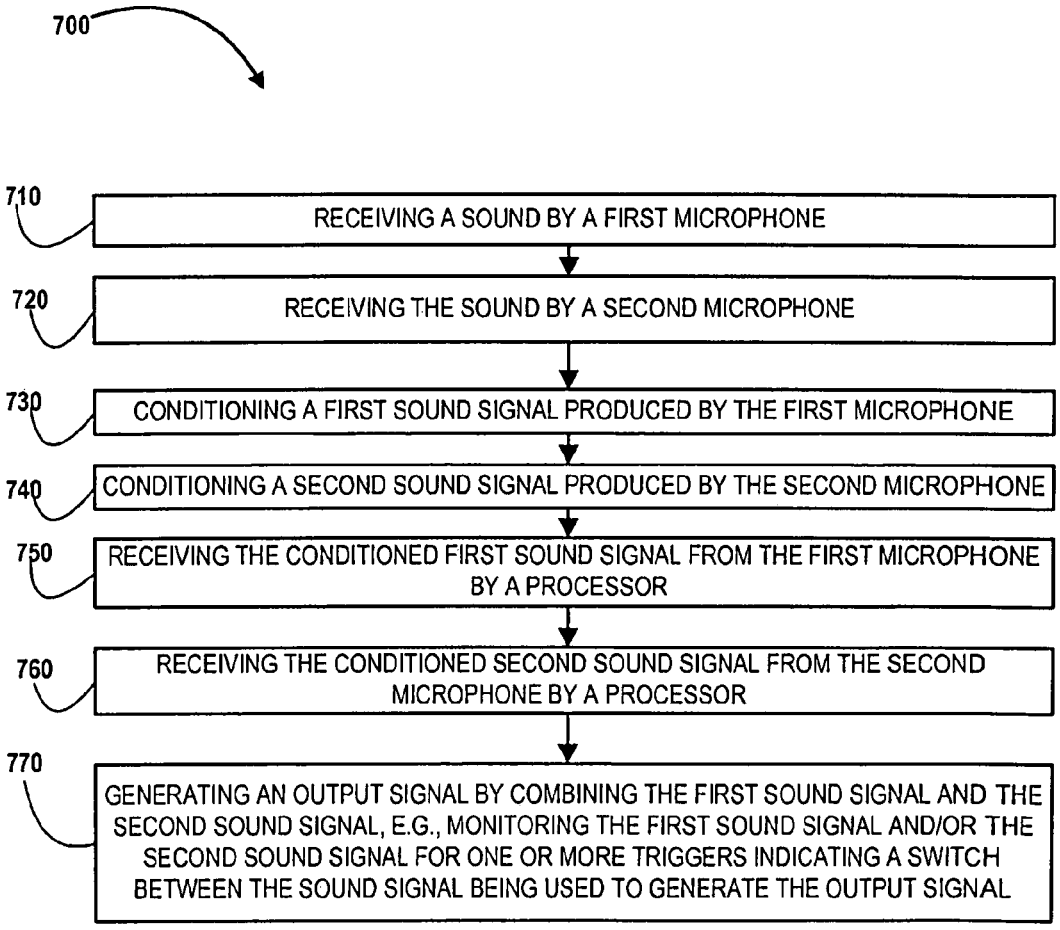

Having thus described embodiments of the invention in general terms, reference will now be made to the accompanying drawings, where:

FIG. 1A is a graph illustrating the dynamic ranges of first and second microphones of the microphone system according to embodiments of the invention;

FIG. 1B is a graph illustrating the transition range of the first and second microphones of the microphone system according to embodiments of the invention;

FIG. 1C is a graph illustrating the dynamic ranges of second and third microphones of the microphone system according to embodiments of the invention;

FIG. 1D is a graph illustrating the transition range of the second and third microphones of the microphone system according to embodiments of the invention;

FIG. 2 is a graph 200 illustrating an output signal such as one generated by the microphone system according to embodiments of the invention;

FIG. 3 is a graph 300 illustrating an example of an output signal generated by the microphone system according to embodiments of the invention;

FIG. 4 is a diagram illustrating a front view of external components of an exemplary device for capturing a sound according to embodiments of the invention;

FIG. 5 is a diagram illustrating a rear view of external components of the exemplary device according to embodiments of the invention;

FIG. 6 is a diagram illustrating internal components of the exemplary device according to embodiments of the invention; and FIG. 7 is an exemplary process flow associated with a microphone system, in accordance with embodiments of the invention.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Microphones are used for receiving audio input into a system, e.g., a computing system or a non-computing system. Sometimes, the audio may be a user's voice (e.g., when a user is participating in a voice call via the system). Other times, the audio may be environmental audio associated with an audio recording or a video recording. As used herein, a microphone may also be referred to as a microphone system. A microphone system may be any computing or non-computing system that comprises a microphone. Examples of microphone systems include, but are not limited to, stand-alone microphones, mobile computing devices (e.g., mobile phones), image-capturing devices (e.g., cameras), gaming devices, laptop computers, portable media players, tablet computers, e-readers, scanners, other portable or non-portable computing or non-computing devices, as well as, in some embodiments, one or more components thereof and/or one or more peripheral devices associated therewith.

Sometimes, the microphone is built into a system described herein. This built-in microphone may capture audio that is broadcast within a predetermined distance from the system. Other times, a wired microphone is plugged into an appropriate microphone jack associated with the system. At such times, a user of the microphone may have to bring the microphone close to the source of the audio (e.g., the user's lips) in order to input the audio (e.g., the user's voice) into the system via the microphone. Still other times, a wireless microphone may be carried by an audio source, and any audio signals received by the wireless microphone are wirelessly transmitted (e.g., via one or more short-range mechanisms such as near-field communication (NFC) or long-range wireless mechanisms (e.g., radio frequency (RF) communication) to a receiver associated with a computing or non-computing system described herein.

Microphones have various limitations on their functionality. One limitation on the functionality of microphones is the dynamic range of the microphone, that is, the range of the sound pressure levels for which a particular microphone provides optimal functionality. For example, a microelectromechanical systems (MEMS) microphones, also referred to as microphone chip microphones or silicon microphones, may be used in mobile devices such as cellular phones and typically have a dynamic range of about 60 dB. With such a limited dynamic range, a typical microphone and the microphone system in which it operates may exhibit deficiencies at high sound pressure levels. For example, such high sound pressure levels may result from a person yelling into a phone, an audio recording of a concert, a car crash, or the like. In high sound pressure level situations, a typical microphone may saturate and capture a heavily distorted representation of the sound. Likewise, a typical microphone and microphone system may exhibit deficiencies at low sound pressure levels. For example, low sound pressure levels may result from a voice distant from the phone in a quiet room, an audio recording of quiet sounds, or the like. In low sound pressure level situations, the noise floor of a typical microphone may drown out such sounds.

In general, embodiments of the invention are directed to systems, methods and computer program products for providing a microphone system having two or more microphones configured to have overlapping dynamic ranges such that a single output signal may be extracted from the two or more microphones depending on their individual saturation levels, noise levels the sound pressure level present. In some embodiments, a microphone system is for receiving a sound and producing an output signal representing the sound. The microphone system has a first microphone having a first dynamic range, the first microphone to receive the sound and produce a first sound signal based on the received sound. It also has a second microphone having a second dynamic range, the second microphone to receive the sound and produce a second sound signal based on the received sound, wherein the first dynamic range and the second dynamic range overlap thereby forming a transition dynamic range and processing logic operatively coupled to the first microphone and the second microphone. The processing logic is configured to receive the first sound signal from the first microphone, receive the second sound signal from the second microphone, and generate the output signal by combining the first sound signal and the second sound signal. In various embodiments, the multiple sound signals from multiple microphones may be combined such that portions of the output signal are taken from multiple sound signals within a single cycle of the sound signal and/or such that portions of the output are taken from one sound signal until one or more triggers are indicated such that the sound signal being used to generate the output signal should be switched.

In various embodiments, more than two microphones may be used in the microphone system to cover a wider dynamic range. For example, three or more high quality microphones covering a narrower dynamic range may be used in conjunction to generate a high quality output signal.

Referring now to FIG. 1A, a graph illustrates the dynamic ranges of two microphones of the microphone system according to embodiments of the invention. The graph 100 has a single variable having units of dB (SPL), which represents the sound pressure level over the standard reference level. As illustrated in FIG. 1A, a first microphone, referred to as "microphone 1" has a dynamic range or a sound pressure level range of 10 dB (SPL) to 90 dB (SPL). As also illustrated in FIG. 1A, a second microphone, referred to as "microphone 2" has a dynamic range or a sound pressure level range of 60 dB (SPL) to 140 dB (SPL). Thus, there is an overlap of dynamic ranges of microphone 1 and microphone 2 from 60 dB (SPL) to 90 dB (SPL), which is also referred to as a transition range as illustrated in FIG. 1B.

As illustrated in FIGS. 1A and 1B, the low end of the dynamic ranges of the microphones may be referred to as the noise level of the particular microphone, thereby indicating that as the sound pressure level of a sound approaches and/or passes the noise level of the microphone, the microphone becomes unable to accurately represent the sound without noise becoming a problem. This low end of the dynamic range of the microphones may also be referred to as a minimum sound pressure level for the microphone. Similarly, as illustrated in FIGS. 1A and 1B, the high end of the dynamic ranges of the microphones may be referred to as the high distortion level for the microphone, the maximum sound pressure level for the microphone, and/or the sound pressure level at which the microphone saturates.

Referring to FIGS. 1C and 1D, in some embodiments, where the first dynamic range has a first minimum sound pressure level and a first maximum sound pressure level and the second dynamic range has a second minimum sound pressure level and a second maximum sound pressure level, and where the first minimum sound pressure level is lower than the second minimum sound pressure level, and the first maximum sound pressure level is lower than the second maximum sound pressure level, the microphone system also includes a third microphone as shown in FIGS. 1C and 1D. The third microphone has a third dynamic range and is to receive the sound and produce a third sound signal based on the received sound. The third dynamic range has a minimum sound pressure level higher than the second minimum sound pressure level and a maximum sound pressure level higher than the second maximum sound pressure level, the processing logic is operatively coupled to the third microphone. The processing logic is further configured to receive the third sound signal from the third microphone and generate the output signal by combining the first sound signal, the second sound signal and the third sound signal at least in part by switching from the second sound signal to the third sound signal based at least in part on the sound pressure level of the second signal rising above the second maximum sound pressure level or based at least in part on the sound pressure level of the second signal rising above the third minimum sound pressure level.

In some embodiments of the microphone system, the output signal is generated by switching between multiple microphones based on determining when specific triggers occur. In some embodiments, for example, a processor may determine a trigger for switching from the first sound signal to the second sound signal produced by microphone 2. The trigger may occur when the first sound signal, produced by the first microphone, passes into the transition range (e.g., when the first sound signal crosses the Low SPL Threshold) or when the first sound signal passes through the transition range (e.g., when the first sound signal crosses the Low SPL Threshold followed by crossing the High SPL Threshold). Likewise, the processor may determine a trigger for switching from the second sound signal to the first sound signal. The trigger may occur when the second sound signal passes into the transition range (e.g., when the second sound signal crosses the High SPL Threshold) or when the second sound signal passes through the transition range (e.g., when the second sound signal crosses the High SPL Threshold followed by crossing the Low SPL Threshold).

In some embodiments, the processor only monitors one of the sound signals to determine triggers for shifting between the microphones. For example, in one embodiment, the processor monitors the first sound signal produced by microphone 1. If the sound pressure level of the first sound signal crosses the Low SPL Threshold, thereby producing a trigger, then the processor switches to the second sound signal for generating the output signal. In this example, however, the processor continues to monitor the first sound signal in order to determine the next trigger. For example, once the sound pressure level of the first sound signal passes back across the Low SPL Threshold, the processor switches back to the first sound signal for generating the output signal. In another example, the processor continues to monitor the second sound signal to determine all the triggers. The processor may generate the output signal using the second sound signal until the second sound signal passes over the High SPL Threshold and the Low SPL Threshold, thereby passing completely through the transition range. Once the second sound signal passes over the Low SPL Threshold, the processor may then switch to the first sound signal for generating the output signal, however, the processor may continue to monitor the second sound signal to determine the next trigger. For example, the processor may switch back to the second sound signal for generating the output signal either when the Low SPL Threshold is crossed, when the High SPL Threshold is crossed or when the Low SPL Threshold and the High SPL Threshold are crossed in succession.

In various embodiments, when the processor determines that a trigger has occurred, the processor instantaneously or substantially instantaneously switches between sound signals for generating the output signal. For example, in one embodiment, the processor monitors the first sound signal and determines that the sound pressure level of the first sound signal crosses both the Low SPL Threshold and the High SPL Threshold, thereby indicating a trigger for switching from the first sound signal to the second sound signal for generating the output signal. In this example, as soon as the trigger is detected, the processor switches between sound signals for generating the output signal.

In contrast, in various other embodiments, when the processor determines that a trigger has occurred, the processor does not instantaneously or substantially instantaneously switch between sound signals for generating the output signal, but rather, waits a predetermined period of time before switching between sound signals. For example, in one embodiment, the processor is monitoring the first sound signal and determines the sound pressure level crosses over the Low SPL Threshold. The processor, upon detecting this trigger, waits a predetermined period of time before switching to the second sound signal for generating the output signal. In this regard, waiting the period of time may allow the system to avoid switching back and forth at a quick pace. For example, if the processor detects the trigger and immediately switches to the other sound signal, the sound pressure level may quickly drop back below the Low SPL Threshold, therefore necessitating a switch back to the first sound signal. By waiting a predetermined period of time, the system may avoid such a double switch, but rather, maintain generation of the output signal based on the first sound signal.

In other words, the processor may wait a predetermined period of time after detecting a trigger for switching, unless another trigger for switching is detected before the predetermined period of time expires. This description may refer to the situation described above where the first sound signal crosses a Low SPL Threshold, and in response the processor starts a clock counting the predetermined period of time. If, during the predetermined period of time, another trigger is indicated, the processor may determine that, either no action needs be taken, or that a switch should be made instantaneously or substantially instantaneously. For example, if the other trigger is the sound pressure level dropping back below the Low SPL Threshold, then the processor may determine that no switch is appropriate. On the other hand, if the other trigger is the sound pressure level rising close to or over the High SPL Threshold, then the processor may determine that an immediate switch to the second sound signal for generating the output signal is necessary. In a situation where the High SPL Threshold is or is close to the saturation level of the first microphone, such an embodiment may be necessary to ensure signal degradation does not occur by waiting the entire predetermined period of time regardless of the fact that the sound pressure level is approaching or has actually crossed over the saturation level of the first microphone.

Referring back to FIG. 2, the graph 200 shows an example of an output signal generated by the microphone system, where the dash-lined signal is taken from the first microphone having a lower dynamic range and the solid-lined signal is taken from the second microphone having a higher dynamic range. As shown, the output signal is generated by a combination of the first and second sound signals within a single cycle of the signal. Thus, in this embodiment, once the processor determines a trigger, the switch is typically instantaneous or close to instantaneous.

In contrast, referring now to FIG. 3, a graph 300 shows an example of an output signal generated by the microphone system, where the dash-lined signal is taken from the first microphone having a lower dynamic range and the solid-lined signal is taken from the second microphone having a higher dynamic range. As shown, the output signal is generated by a combination of the first and second sound signals, but is not shown as a combination within one cycle of the output signal. This example may illustrate a situation where the processor is determining the RMS of the sound pressure level and determines its triggers based on the RMS sound pressure level as opposed to the instantaneous sound pressure level. In this example, the second sound signal, that is, the sound signal generated by the second microphone is used for the output signal both while the amplitude of the output signal as well as the RMS of the output signal is higher than, for example, the Low SPL Threshold. In this regard, the output signal maintains high quality, particularly for the higher SPL sections of the signal. Once the processor determines that the sound pressure level of the sound has decreased, for example, that the RMS of the first or second sound signal has decreased below a threshold, such as below the Low SPL Threshold, the processor then switches from the second sound signal to the first sound signal for generating the output signal, as illustrated by the change from the solid-lined signal to the dash-lined signal of FIG. 3.

In some embodiments, when the sound signal is within the transition region, i.e., inside the overlap of dynamic regions of two of the microphones of the microphone system, the first sound signal and the second sound signal may be combined as shown in FIG. 2 above such that the lower amplitude portions of the output signal are generated from the first sound signal and the higher amplitude portions of the output signal are generated from the second sound signal, thereby creating the output signal. In some such embodiments, the sound signals may be combined by weighting, for example, the second sound signal (from the higher dynamic range microphone) versus the first sound signal (from the lower dynamic range microphone). Additionally, in various embodiments, smothering filters may be applied to one or both the first and/or second sound signals within the transition range such that some or all the first and/or second sound signals are suppressed within the transition range.

Referring now to FIG. 4, a diagram illustrating a front view of external components of an exemplary device for capturing a sound is shown. As illustrated, device 112 may include a housing 305, a microphone 310, a speaker 320, a keypad 330, function keys 340, a display 350, and a camera button 360.

Housing 305 may include a structure configured to contain or at least partially contain components of device 112. For example, housing 305 may be formed from plastic, metal or other natural or synthetic materials or combination(s) of materials and may be configured to support microphone 310, speaker 320, keypad 330, function keys 340, display 350, and camera button 360.

Microphone 310 may include any component capable of transducing air pressure waves to a corresponding electrical signal. For example, a user may speak into microphone 310 during a telephone call. Microphone 310 may be used to receive audio from the user or from the environment surround the device 112. In some embodiments discussed herein, the microphone 310 represents more than one microphone, such as two, three or more microphones. In some embodiments, the microphone 310 includes, for example, multiple microphones that share the same hole in the housing 305. In some embodiments, the multiple microphones are all MEMS microphones, and in some embodiments, the multiple microphones share space on a single chip.

Speaker 320 may include any component capable of transducing an electrical signal to a corresponding sound wave. For example, a user may listen to music through speaker 320.

Keypad 330 may include any component capable of providing input to device 112. Keypad 330 may include a standard telephone keypad. Keypad 330 may also include one or more special purpose keys. In one implementation, each key of keypad 330 may be, for example, a pushbutton. Keypad 330 may also include a touch screen. A user may utilize keypad 330 for entering information, such as text or a phone number, or activating a special function.

Function keys 340 may include any component capable of providing input to device 112. Function keys 340 may include a key that permits a user to cause device 112 to perform one or more operations. The functionality associated with a key of function keys 340 may change depending on the mode of device 112. For example, function keys 340 may perform a variety of operations, such as recording audio, placing a telephone call, playing various media, setting various camera features (e.g., focus, zoom, etc.) or accessing an application. Function keys 340 may include a key that provides a cursor function and a select function. In one implementation, each key of function keys 340 may be, for example, a pushbutton.

Display 350 may include any component capable of providing visual information. For example, in one implementation, display 350 may be a liquid crystal display (LCD). In another implementation, display 350 may be any one of other display technologies, such as a plasma display panel (PDP), a field emission display (FED), a thin film transistor (TFT) display, etc. Display 350 may be utilized to display, for example, text, image, and/or video information. Display 350 may also operate as a view finder, as will be described later. Display 350 may also be used as a user interface to enable a user to configure the process of recording audio and/or adjusting the recorded audio. Camera button 360 may be a pushbutton that enables a user to take an image.

Since device 112 illustrated in FIG. 4 is exemplary in nature, device 112 is intended to be broadly interpreted to include any type of electronic device that includes an sound capturing component or components such as the microphone system described herein. For example, device 112 may include a wireless phone, a personal digital assistant (PDA), a portable computer, a camera, or a wrist watch. In other instances, device 112 may include, for example, security devices or military devices. Accordingly, although FIGS. 4 and 5 illustrate exemplary external components of device 112, in other implementations, device 112 may contain fewer, different, or additional external components than the external components depicted in FIGS. 4 and 5. Additionally, or alternatively, one or more external components of device 112 may include the capabilities of one or more other external components of device 112. For example, display 350 may be an input component (e.g., a touch screen). Additionally, or alternatively, the external components may be arranged differently than the external components depicted in FIGS. 4 and 5.

Referring now to FIG. 5, a diagram illustrates a rear view of external components of the exemplary device. As illustrated, in addition to the components previously described, device 112 may include a camera 470, a lens assembly 472, a proximity sensor 476, and a flash 474.

Camera 470 may include any component capable of capturing an image or a stream of images (video). Camera 470 may be a digital camera or a digital video camera. Display 350 may operate as a view finder when a user of device 112 operates camera 470. Camera 470 may provide for automatic and/or manual adjustment of a camera setting. In one implementation, device 112 may include camera software that is displayable on display 350 to allow a user to adjust a camera setting. For example, a user may be able adjust a camera setting by operating function keys 340.

Lens assembly 472 may include any component capable of manipulating light so that an image may be captured. Lens assembly 472 may include a number of optical lens elements. The optical lens elements may be of different shapes (e.g., convex, biconvex, plano-convex, concave, etc.) and different distances of separation. An optical lens element may be made from glass, plastic (e.g., acrylic), or plexiglass. The optical lens may be multicoated (e.g., an antireflection coating or an ultraviolet (UV) coating) to minimize unwanted effects, such as lens flare and inaccurate color. In one implementation, lens assembly 472 may be permanently fixed to camera 470. In other implementations, lens assembly 472 may be interchangeable with other lenses having different optical characteristics. Lens assembly 472 may provide for a variable aperture size (e.g., adjustable f-number).

Proximity sensor 476 (not shown in FIG. 3) may include any component capable of collecting and providing distance information that may be used to enable camera 470 to capture an image properly. For example, proximity sensor 476 may include an infrared (IR) proximity sensor that allows camera 470 to compute the distance to an object, such as a human face, based on, for example, reflected IR strength, modulated IR, or triangulation. In another implementation, proximity sensor 476 may include an acoustic proximity sensor. The acoustic proximity sensor may include a timing circuit to measure echo return of ultrasonic soundwaves. In embodiments that include a proximity sensor 476, the proximity sensor may be used to determine a distance to one or more moving objects, which may or may not be in focus, either prior to, during, or after capturing of an image frame of a scene.

Flash 474 may include any type of light-emitting component to provide illumination when camera 470 captures an image. For example, flash 474 may be a light-emitting diode (LED) flash (e.g., white LED) or a xenon flash. In another implementation, flash 474 may include a flash module.

Although FIG. 5 illustrates exemplary external components, in other implementations, device 112 may include fewer, additional, and/or different components than the exemplary external components depicted in FIG. 5. For example, in other implementations, camera 470 may be a film camera. Additionally, or alternatively, depending on device 112, flash 474 may be a portable flashgun. Additionally, or alternatively, device 112 may be a single-lens reflex camera. In still other implementations, one or more external components of device 112 may be arranged differently.

Referring now to FIG. 6, a diagram illustrates internal components of the exemplary system for capturing a sound. As illustrated, device 112 may include microphone 310, speaker 320, keypad 330, function keys 340, display 350, a memory 500, a transceiver 520, and a control unit 530.

Memory 500 may include any type of storing component to store data and instructions related to the operation and use of device 112. For example, memory 500 may include a memory component, such as a random access memory (RAM), a read only memory (ROM), and/or a programmable read only memory (PROM). Additionally, memory 500 may include a storage component, such as a magnetic storage component (e.g., a hard drive) or other type of computer-readable or computer-executable medium. Memory 500 may also include an external storing component, such as a Universal Serial Bus (USB) memory stick, a digital camera memory card, and/or a Subscriber Identity Module (SIM) card.

Memory 500 may include a code component 510 that includes computer-readable or computer-executable instructions to perform one or more functions. These functions include initiating and/or executing one or more of the steps and/or processes discussed herein. However, the functions are not limited to those illustrated in FIG. 7. The code component 510 may work in conjunction with one or more other hardware or software components associated with the device 112 to initiate and/or execute the processes illustrated in FIG. 7 or other steps or processes described herein. Additionally, code component 510 may include computer-readable or computer-executable instructions to provide other functionality other than as described herein.

Transceiver 520 may include any component capable of transmitting and receiving information wirelessly or via a wired connection. For example, transceiver 520 may include a radio circuit that provides wireless communication with a network or another device.

Control unit 530 may include any logic that may interpret and execute instructions, and may control the overall operation of device 112. Logic, as used herein, may include hardware, software, and/or a combination of hardware and software. Control unit 530 may include, for example, a general-purpose processor, a microprocessor, a data processor, a co-processor, and/or a network processor. Control unit 530 may access instructions from memory 500, from other components of device 112, and/or from a source external to device 112 (e.g., a network or another device).

Control unit 530 may provide for different operational modes associated with device 112. For example, a first mode is a mode whereby multiple microphones are used to capture a sound as illustrated in FIG. 2, whereas a second mode multiple microphones are used to capture a sound as illustrated in FIG. 3. Additionally, control unit 530 may operate in multiple modes simultaneously. For example, control unit 530 may operate in a camera mode, a walkman mode, and/or a telephone mode. For example, when in camera mode, logic may enable device 112 to capture video and/or audio.

Although FIG. 6 illustrates exemplary internal components, in other implementations, device 112 may include fewer, additional, and/or different components than the exemplary internal components depicted in FIG. 6. For example, in one implementation, device 112 may not include transceiver 520. In still other implementations, one or more internal components of device 112 may include the capabilities of one or more other components of device 112. For example, transceiver 520 and/or control unit 530 may include their own on-board memory.

In some embodiments, the microphone system as discussed herein includes one or more of the components illustrated in FIG. 6. For example, in one embodiment, the microphone system includes the memory 500, the control unit 530 and the microphone 310. In some embodiments, the control unit 530 includes one or more processors in communication with the two or more microphones represented by microphone 310. In some embodiments, the microphone system also includes one or more analog to digital converters, and/or one or more buffers, and/or one or more other components. In some embodiments, a first analog to digital converter is operatively connected to a first microphone for converting the first sound signal from an analog to a digital signal. Further, a second analog to digital converter may be operatively connected to a second microphone for converting the second sound signal from an analog to a digital signal. In some embodiments, the output(s) of the analog to digital converter(s) may be operatively connected to the control unit 530, such as to a processor of the control unit 530. In some embodiments, the microphone system also includes one or more buffers for buffering the signal before it is received by the control unit 530. For example, in one embodiment, a buffer is operatively connected to the output of an analog to digital converter operatively connected to a first microphone and another buffer is operatively connected to the output of another analog to digital converter operatively connected to a second microphone.

Referring now to FIG. 7, a process flow 700 for an exemplary microphone system according to embodiments of the invention is shown. At block 710, a first microphone associated with the microphone system may receive a sound. At block 720, a second microphone associated with the microphone system may receive the sound. At block 730, a first sound signal produced by the first microphone and corresponding to the received sound is conditioned. At block 740, a second sound signal produced by the second microphone and corresponding to the received sound is also conditioned. Conditioning may refer to a variety of pre-processing steps. For example, in some embodiments, the conditioning may include conversion from analog to digital such as by using a separate analog to digital converter for each sound signal.

In some embodiments, as another example, one or both the first and second sound signals are passed through one or two buffers before being sent to the processor. In some embodiments, a distinct buffer is used for each microphone, thereby providing an opportunity to calculate shifting and/or weighting parameters regarding the first and second sound signals based on instant and/or historical values. Additionally, the current shifting and/or weighting parameters may be used as input for the processor to control the shifting and/or weighting at the output of the buffer(s). Accordingly, such a technique may be referred to as using "future" values for shifting and/or weighting.

Referring back to FIG. 7, at block 750, a processor receives the conditioned first sound signal from the first microphone. Similarly, at block 760, the processor receives the conditioned second sound signal from the second microphone. The last step, represented by block 770, is generating an output signal. The output signal may be generated by combining the first sound signal and the second sound signal. Combining the first and second sound signals may be done by combining the sound signals within a single cycle of the output signal or may be done as an RMS sound pressure value of the sound signal(s) indicates a trigger such that the sound signals generating the output signal should be switched. For example, the sound pressure value crosses over a saturation level of a first microphone, thereby indicating that a second sound signal produced by a second microphone should be used to generate the output signal instead of the previously used first sound signal of the first microphone.

In some embodiments, the process flow may be performed in the order shown in FIG. 7, while in other embodiments, the process flow may be performed in a different order from that presented in FIG. 7 and may include fewer steps than those shown or may include other steps discussed elsewhere herein or other steps not discussed herein.

In various embodiments, using multiple microphones as described herein to achieve a greater sound pressure level range may be combined with the prior art configurations where multiple microphones are used to achieve a greater frequency bandwidth. In some embodiments. For example, in one embodiment, a first microphone has a low frequency bandwidth as well as a low sound pressure level range and a second microphone has a high frequency bandwidth overlapping with the low frequency bandwidth of the first microphone and a high sound pressure level range overlapping with the low sound pressure level range of the first microphone such that both a wide frequency bandwidth and a wide sound pressure level range are achieved.

In various embodiments discussed herein, filtering may be applied before, during or after switching between a first sound signal to a second sound signal and from a second sound signal to a first sound signal or switching between multiple sound signals in a case where multiple microphones are used to achieve greater sound pressure level ranges. For example, in one embodiment, time alignment filtering may be used, and in another embodiment, smoothing filtering may be used.

As discussed with reference to various embodiments, switching between sound signals from multiple microphones may be done in real time or substantially in real time. However, in some applications it may be beneficial to record one or more sound signals from one or more microphones included in various embodiments of the system disclosed herein. Accordingly, in some embodiments, switching may be done as post-processing, that is, after one or more of the sound signals have been recorded, post-processing may filter the signals or otherwise condition the signals in some embodiments. In other embodiments, post-processing may be performed on one or more of the signals in order to combine them, such as by determining switching points in order to generate the output signal. For example, in some embodiments, various criteria may be verified regarding one or more of the sound signals before performing a switch changing the sound signal being used to generate the output signal for various points in time. In some implementations, a recording studio engineer or producer or other administrator may verify one or more of the criteria before authorizing a switch between the sound signals being used to generate the output signal.

In summary, embodiments of the invention are directed to systems, methods and computer program products for providing a microphone system having two or more microphones configured to have overlapping dynamic ranges such that a single output signal may be extracted from the two or more microphones depending on their individual saturation levels, noise levels the sound pressure level present. In some embodiments, a microphone system is for receiving a sound and producing an output signal representing the sound. The microphone system has a first microphone having a first dynamic range, the first microphone to receive the sound and produce a first sound signal based on the received sound. It also has a second microphone having a second dynamic range, the second microphone to receive the sound and produce a second sound signal based on the received sound, wherein the first dynamic range and the second dynamic range overlap thereby forming a transition dynamic range and processing logic operatively coupled to the first microphone and the second microphone. The processing logic is configured to receive the first sound signal from the first microphone, receive the second sound signal from the second microphone, and generate the output signal by combining the first sound signal and the second sound signal.

In accordance with embodiments of the invention, the term "module" with respect to a system (or a device) may refer to a hardware component of the system, a software component of the system, or a component of the system that includes both hardware and software. As used herein, a module may include one or more modules, where each module may reside in separate pieces of hardware or software.

As used herein, the term "automatic" refers to a function, a process, a method, or any part thereof, which is executed by computer software upon occurrence of an event or a condition without intervention by a user.

Although many embodiments of the present invention have just been described above, the present invention may be embodied in many different forms and should not be construed as limited to the embodiments set forth herein; rather, these embodiments are provided so that this disclosure will satisfy applicable legal requirements. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein. Like numbers refer to like elements throughout.

As will be appreciated by one of ordinary skill in the art in view of this disclosure, the present invention may include and/or be embodied as an apparatus (including, for example, a system, machine, device, computer program product, and/or the like), as a method (including, for example, a business method, computer-implemented process, and/or the like), or as any combination of the foregoing. Accordingly, embodiments of the present invention may take the form of an entirely business method embodiment, an entirely software embodiment (including firmware, resident software, microcode, stored procedures in a database, etc.), an entirely hardware embodiment, or an embodiment combining business method, software, and hardware aspects that may generally be referred to herein as a "system." Furthermore, embodiments of the present invention may take the form of a computer program product that includes a computer-readable storage medium having one or more computer-executable program code portions stored therein. As used herein, a processor, which may include one or more processors, may be "configured to" perform a certain function in a variety of ways, including, for example, by having one or more general-purpose circuits perform the function by executing one or more computer-executable program code portions embodied in a computer-readable medium, and/or by having one or more application-specific circuits perform the function.

It will be understood that any suitable computer-readable medium may be utilized. The computer-readable medium may include, but is not limited to, a non-transitory computer-readable medium, such as a tangible electronic, magnetic, optical, electromagnetic, infrared, and/or semiconductor system, device, and/or other apparatus. For example, in some embodiments, the non-transitory computer-readable medium includes a tangible medium such as a portable computer diskette, a hard disk, a random access memory (RAM), a read-only memory (ROM), an erasable programmable read-only memory (EPROM or Flash memory), a compact disc read-only memory (CD-ROM), and/or some other tangible optical and/or magnetic storage device. In other embodiments of the present invention, however, the computer-readable medium may be transitory, such as, for example, a propagation signal including computer-executable program code portions embodied therein.

One or more computer-executable program code portions for carrying out operations of the present invention may include object-oriented, scripted, and/or unscripted programming languages, such as, for example, Java, Perl, Smalltalk, C++, SAS, SQL, Python, Objective C, JavaScript, and/or the like. In some embodiments, the one or more computer-executable program code portions for carrying out operations of embodiments of the present invention are written in conventional procedural programming languages, such as the "C" programming languages and/or similar programming languages. The computer program code may alternatively or additionally be written in one or more multi-paradigm programming languages, such as, for example, F#.

Some embodiments of the present invention are described herein with reference to flowchart illustrations and/or block diagrams of apparatus and/or methods. It will be understood that each block included in the flowchart illustrations and/or block diagrams, and/or combinations of blocks included in the flowchart illustrations and/or block diagrams, may be implemented by one or more computer-executable program code portions. These one or more computer-executable program code portions may be provided to a processor of a general purpose computer, special purpose computer, and/or some other programmable data processing apparatus in order to produce a particular machine, such that the one or more computer-executable program code portions, which execute via the processor of the computer and/or other programmable data processing apparatus, create mechanisms for implementing the steps and/or functions represented by the flowchart(s) and/or block diagram block(s).

The one or more computer-executable program code portions may be stored in a transitory and/or non-transitory computer-readable medium (e.g., a memory, etc.) that can direct, instruct, and/or cause a computer and/or other programmable data processing apparatus to function in a particular manner, such that the computer-executable program code portions stored in the computer-readable medium produce an article of manufacture including instruction mechanisms which implement the steps and/or functions specified in the flowchart(s) and/or block diagram block(s).

The one or more computer-executable program code portions may also be loaded onto a computer and/or other programmable data processing apparatus to cause a series of operational steps to be performed on the computer and/or other programmable apparatus. In some embodiments, this produces a computer-implemented process such that the one or more computer-executable program code portions which execute on the computer and/or other programmable apparatus provide operational steps to implement the steps specified in the flowchart(s) and/or the functions specified in the block diagram block(s). Alternatively, computer-implemented steps may be combined with, and/or replaced with, operator- and/or human-implemented steps in order to carry out an embodiment of the present invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A microphone system for receiving a sound and producing an output signal representing the sound, the microphone system comprising:

a first microphone having a first dynamic range, the first microphone to receive the sound and produce a first sound signal based on the received sound;

a second microphone having a second dynamic range, the second microphone to receive the sound and produce a second sound signal based on the received sound, wherein the first dynamic range and the second dynamic range overlap thereby forming a transition dynamic range; and processing logic operatively coupled to the first microphone and the second microphone, the processing logic configured to:

receive the first sound signal from the first microphone;

receive the second sound signal from the second microphone; and generate the output signal by combining the first sound signal and the second sound signal, wherein generating comprises:

monitoring the first sound signal to determine that a sound pressure level of the first sound signal has crossed a first predetermined threshold;

in response to determining that the sound pressure level of the first sound signal has crossed the predetermined threshold, initiating a clock counting a predetermined period of time after which the output signal will switch from the first sound signal to the second sound signal;

monitoring the first sound signal to determine that the sound pressure level of the first sound signal has crossed a second predetermined threshold different than the first predetermined threshold; and in response to determining that the sound pressure level of the first sound signal has crossed the second predetermined threshold, switching from the first sound signal to the second sound signal without waiting the entirety of the predetermined period of time.

2. The microphone system of claim 1, wherein:

the first dynamic range has a first minimum sound pressure level and a first maximum sound pressure level and the second dynamic range has a second minimum sound pressure level and a second maximum sound pressure level;

the first minimum sound pressure level is lower than the second minimum sound pressure level; and the first maximum sound pressure level is lower than the second maximum sound pressure level.

3. The microphone system of claim 2, wherein the processing logic is configured to generate the output signal by combining the first sound signal and the second sound signal at least in part by:

switching from the first sound signal to the second sound signal based at least in part on a sound pressure level of the first sound signal rising above the first maximum sound pressure level.

4. The microphone system of claim 2, wherein the processing logic is configured to generate the output signal by combining the first sound signal and the second sound signal at least in part by:

switching from the first sound signal to the second sound signal based at least in part on a sound pressure level of the first sound signal rising above the second minimum sound pressure level.

5. The microphone system of claim 2, wherein the processing logic is configured to generate the output signal by combining the first sound signal and the second sound signal at least in part by:

switching from the second sound signal to the first sound signal based at least in part on a sound pressure level of the second sound signal falling below the first maximum sound pressure level.

6. The microphone system of claim 2, wherein the processing logic is configured to generate the output signal by combining the first sound signal and the second sound signal by:

switching from the second sound signal to the first sound signal based at least in part on a sound pressure level of the second sound signal falling below the second minimum sound pressure level.

7. The microphone system of claim 2, further comprising:

a third microphone having a third dynamic range, the third microphone to receive the sound and produce a third sound signal based on the received sound;

wherein the third dynamic range has a minimum sound pressure level higher than the second minimum sound pressure level and a maximum sound pressure level higher than the second maximum sound pressure level;

wherein the processing logic is operatively coupled to the third microphone;

wherein the processing logic is further configured to:

receive the third sound signal from the third microphone; and generate the output signal by combining the first sound signal, the second sound signal and the third sound signal at least in part by:

switching from the second sound signal to the third sound signal based at least in part on the sound pressure level of the second signal rising above the second maximum sound pressure level or based at least in part on the sound pressure level of the second signal rising above the third minimum sound pressure level.

8. The microphone system of claim 1, further comprising:

a first analog to digital converter configured to receive the first sound signal and convert the first sound signal from analog to digital prior to the processing logic receiving the first sound signal; and a second analog to digital converter configured to receive the second sound signal and convert the second sound signal from analog to digital prior to the processing logic receiving the second sound signal.

9. The microphone system of claim 1, wherein:

the processing logic is configured to generate the output signal by combining the first sound signal and the second sound signal at least in part by:

switching from the first sound signal to the second sound signal based at least in part on the first microphone becoming saturated.

10. The microphone system of claim 1, wherein:

the processing logic is configured to generate the output signal by combining the first sound signal and the second sound signal at least in part by:

switching from the second sound signal to the first sound signal based at least in part on the second microphone reaching a noise level.

11. The microphone system of claim 1, wherein the processing logic is configured to generate the output signal by combining the first sound signal and the second sound signal at least in part by:

switching between the first sound signal and the second sound signal substantially instantaneously in response to the first sound signal or the second sound signal passing through the transition dynamic range.

12. The microphone system of claim 1, wherein the processing logic is configured to generate the output signal by combining the first sound signal and the second sound signal at least in part by:

switching from the second sound signal to the first sound signal based at least in part on the second microphone reaching a noise level for a predetermined period of time.

13. The microphone system of claim 1, wherein the first microphone and the second microphone are microelectromechanical system (MEMS) microphones.

14. The microphone system of claim 13, wherein the first microphone and the second microphone share a single input hole in a housing of a mobile device.

15. The microphone system of claim 13, wherein the first microphone and the second microphone are disposed on a single chip.

16. A method for receiving a sound and producing an output signal representing the sound, the method comprising:

providing a microphone system comprising:

a first microphone having a first dynamic range, the first microphone to receive the sound and produce a first sound signal based on the received sound; and a second microphone having a second dynamic range, the second microphone to receive the sound and produce a second sound signal based on the received sound, wherein the first dynamic range and the second dynamic range overlap thereby forming a transition dynamic range;

wherein the first dynamic range has a minimum sound pressure level and a maximum sound pressure level and the second dynamic range has a minimum sound pressure level and a maximum sound pressure level;

wherein the first minimum sound pressure level is lower than the second minimum sound pressure level; and wherein the first maximum sound pressure level is lower than the second maximum sound pressure level; and receiving the first sound signal from the first microphone;

receiving the second sound signal from the second microphone; and generating the output signal by combining the first sound signal and the second sound signal at least in part by:

monitoring the first sound signal to determine that a sound pressure level of the first sound signal has crossed a first predetermined threshold;

in response to determining that the sound pressure level of the first sound signal has crossed the predetermined threshold, initiating a clock counting a predetermined period of time after which the output signal will switch from the first sound signal to the second sound signal;

monitoring the first sound signal to determine that the sound pressure level of the first sound signal has crossed a second predetermined threshold different than the first predetermined threshold; and in response to determining that the sound pressure level of the first sound signal has crossed the second predetermined threshold, switching from the first sound signal to the second sound signal; and switching from the second sound signal to the first sound signal based at least in part on the second microphone reaching a noise level.

17. The method of claim 16, wherein generating the output signal comprises:

switching from the second sound signal to the first sound signal based at least in part on the second microphone reaching a noise level for a predetermined period of time.

18. A computer program product for receiving a sound and producing an output signal representing the sound, the computer program product comprising:

a non-transitory computer-readable medium comprising computer-executable instructions for:

receiving a first sound signal from a first microphone;

receiving a second sound signal from a second microphone; and generating the output signal by combining the first sound signal and the second sound signal at least in part by:

monitoring the first sound signal to determine that a sound pressure level of the first sound signal has crossed a first predetermined threshold;

in response to determining the sound pressure level of the first sound signal has crossed the predetermined threshold, initiating a clock counting a predetermined period of time after which the output signal will switch from the first sound signal to the second sound signal;

monitoring the first sound signal to determine that the sound pressure level of the first sound signal has crossed a second predetermined threshold different than the first predetermined threshold; and in response to determining that the sound pressure level of the first sound signal has crossed the second predetermined threshold, switching from the first sound signal to the second sound signal; and switching from the second sound signal to the first sound signal based at least in part on the second microphone reaching a noise level.

19. The computer program product of claim 18, wherein the instructions for generating the output signal comprise instructions for:

switching from the second sound signal to the first sound signal based at least in part on the second microphone reaching a noise level for a predetermined period of time.

* * * * *